US009321140B2

(12) United States Patent
Kopmanis

(10) Patent No.: US 9,321,140 B2
(45) Date of Patent: Apr. 26, 2016

(54) SYSTEM FOR MACHINE GRINDING A CRANKSHAFT

(71) Applicant: Ford Global Technologies, LLC, Dearborn, MI (US)

(72) Inventor: Michael A Kopmanis, Monroe, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 246 days.

(21) Appl. No.: 13/956,425

(22) Filed: Aug. 1, 2013

(65) Prior Publication Data

US 2015/0038059 A1 Feb. 5, 2015

(51) Int. Cl.

| | |
|---|---|
| ***B24B 5/42*** | (2006.01) |
| ***B24B 27/00*** | (2006.01) |
| ***B24B 51/00*** | (2006.01) |

(52) U.S. Cl.

CPC ..... *B24B 5/42* (2013.01); *B24B 27/0023* (2013.01); *B24B 51/00* (2013.01)

(58) Field of Classification Search

CPC ..... B24B 5/04; B24B 5/42; B24B 5/423; B24B 21/008; B24B 27/0023

USPC ..... 451/49, 65, 179

See application file for complete search history.

(56) References Cited

U.S. PATENT DOCUMENTS

| | | | | |
|---|---|---|---|---|
| 4,205,488 | A * | 6/1980 | Englander et al. | 451/5 |
| 4,584,795 | A * | 4/1986 | Akabane | 451/5 |
| 5,681,208 | A | 10/1997 | Junker | |
| 5,997,452 | A * | 12/1999 | Assie | 483/15 |
| 6,322,300 | B1 * | 11/2001 | Santorius et al. | 409/199 |
| 6,334,806 | B1 | 1/2002 | Sano et al. | |
| 6,409,573 | B1 | 6/2002 | Mukai et al. | |
| 6,419,563 | B1 * | 7/2002 | Ido et al. | 451/57 |
| 6,878,043 | B1 | 4/2005 | Junker | |
| 6,926,591 | B2 | 8/2005 | Horsky et al. | |
| 7,147,547 | B2 * | 12/2006 | Junker | 451/57 |
| 8,172,644 | B2 | 5/2012 | Mizutani et al. | |
| 2006/0116052 | A1 * | 6/2006 | Hori et al. | 451/11 |
| 2008/0311828 | A1 * | 12/2008 | Itoh et al. | 451/49 |
| 2009/0258576 | A1 * | 10/2009 | Mizutani et al. | 451/53 |
| 2010/0173565 | A1 | 7/2010 | Junker | |
| 2010/0203805 | A1 | 8/2010 | Junker | |
| 2011/0053467 | A1 | 3/2011 | Dibner et al. | |
| 2013/0045665 | A1 * | 2/2013 | Schmitz | 451/160 |

OTHER PUBLICATIONS

Landis Gardner, "Crankshaft Grinder performs work of 4 separate machines.", Thomasnet News at http://news.thomasnet.com/fullstory/Crankshaft-Grinder-performs-work-of-4-separate-machines-13079, downloaded on May 17, 2013, 3 pages.

Berco, "The Machine, CNC Orbital Grinder", http://www.lynx2000.net/machine01.asp, downloaded on May 17, 2013, 2 pages.

* cited by examiner

*Primary Examiner* — Monica Carter
*Assistant Examiner* — Marcel Dion
(74) *Attorney, Agent, or Firm* — Damian Porcari; Brooks Kushman P.C.

(57) ABSTRACT

A machine grinding system is provided for machine grinding the main bearing journals, pin bearing journals, the post surface, gear-fit wall surface, and the flywheel flange surfaces of a four cylinder crankshaft. The system includes three operating stations, each operating station only requiring one machine to maintain the desired production rate. The first operating station machine grinds the main bearing journals, post surface, and gear-fit wall surface; the second operating station machine grinds the pin journals; and the third operating station machine grinds the thrust bearing surfaces and the flywheel flange surfaces.

6 Claims, 6 Drawing Sheets

SYSTEM FOR MACHINE GRINDING A CRANKSHAFT

TECHNICAL FIELD

This invention relates to systems for grinding various surfaces of a crankshaft.

BACKGROUND

Internal combustion engines generally require the use of a crankshaft to convert linear motion to rotational motion. Several surfaces of the crankshaft having various functions require machining to ensure proper operation of the crankshaft. Typically, some of the machining processes consist of spinning the crankshaft about a longitudinal axis that defines the main bearing journal axis of the crankshaft, while at the same time utilizing rotary grinding wheels to machine several various surfaces. This process is known as machine grinding. Since a number of surfaces of the crankshaft require machine grinding, several machining steps are required to create the finished crankshaft.

The typical current machine grinding process for four cylinder engine crankshafts uses three machine grinding steps. In order to maintain a desired production rate, more than one grinding machine may be required at each machining step. The requirement of additional machines increases the overall cost by requiring the purchase and operation of additional equipment.

The first grinding step currently used, grinds the five main bearing journal surfaces and post surface of a four cylinder engine crankshaft using multiple grinding wheels on a single spindle. One grinding machine may be utilized to meet the desired production rate. However, this configuration presents limitations when multiple crankshaft designs are being machined because the changeover time to convert the grinding machine from one crankshaft designs to another is time consuming, shutting down production and increasing labor costs. In order to maintain the desired production rate, the current solution is to utilize multiple grinding machines, one machine dedicated to each crankshaft design.

The second grinding step currently used, grinds the crankshaft pin journals using a wheel grinding machine. One grinding machine will typically to meet the desired production rate.

The third machine grinding step currently used grinds the two thrust bearing surfaces, the flywheel flange surfaces, and the gear-fit wall surface; the flywheel flange surfaces consisting of the flywheel flange mating surface, the oil seal surface, and the pilot bore hub surface. This configuration presents limitations because two machines are required in order to maintain the desired production rate.

It would be desirable to provide a crankshaft grinding system for four cylinder engine crankshafts that requires only one grinding machine, at each of the three machine grinding steps, capable of obtaining the desired production rate.

SUMMARY

In a first illustrative embodiment, a system for grinding a four cylinder crankshaft is provided having three grinding stations. Each grinding station requiring only one grinding machine which is capable of obtaining the desired production rate and having a minimal time requirement to convert the grinding machine from one crankshaft part type to another.

The first grinding station machine grinds the main bearing journals, post surface, the gear-fit wall surface. In the first grinding station a clamping fixture secures and rotates the crankshaft about the longitudinal axis that defines the center line of the main bearing journals.

While the crankshaft is rotating in the first station, a first spindle supporting a pair of ganged main bearing journal grinding wheels (the ganged main bearing journal grinding wheels being aligned longitudinally with a first pair of main bearing journals) advances toward the crankshaft in a radial direction with respect to the main bearing journals. The ganged main bearing journal grinding wheels then come into contact with the first pair of the main bearing journals and machine grind them to the desired dimensions. The first spindle then retracts from the crankshaft, shifts longitudinally with respect to the main bearing journals to a position that is aligned longitudinally with a second pair of main bearing journals. Again, the first spindle advances toward the crankshaft in a radial direction with respect to the main bearing journals. The ganged main bearing journal grinding wheels then come into contact with the second pair of the main bearing journals and machine grind them to the desired dimensions. Once the second pair of main bearing journals is machine ground, the first spindle retracts from the crankshaft and returns to the longitudinal position where the ganged main bearing journal grinding wheels are aligned with the first pair of main bearing journals.

Also, while the crankshaft is rotating in the first station, a second spindle supporting a grinding wheel (the grinding wheel having a main bearing journal grinding surface of the grinding wheel that is aligned longitudinally with a main bearing journal, and the second spindle having an axis of rotation that is parallel with the longitudinal axis that defines the center line of the main bearing journals of the crankshaft) advances toward the crankshaft in a radial direction with respect to the main bearing journal. The main bearing journal grinding surface of the grinding wheel then comes into contact with the main bearing journal and machine grinds the journal to the desired dimension. The second spindle then retracts from the crankshaft, rotates about a B-axis, which is perpendicular to both the longitudinal axis that defines the center line of the main bearing journals and a radial axis, to an angled position with respect to the longitudinal axis. Once the second spindle is in the angled position, the second spindle then advances toward the crankshaft where a post grinding surface and a gear-fit wall grinding surface come into contact with the post surface and gear-fit wall surface, respectively, and machine grind the post surface and gear-fit wall surface to the desired dimensions. The second spindle then retracts from the crankshaft and rotates back about the B-axis, so that the second spindle axis is once again aligned parallel with the longitudinal axis that defines the center line of the main bearing journals of the crankshaft.

The second grinding station machine grinds the crankshaft pin journals. In the second grinding station a clamping fixture secures and rotates the crankshaft about the longitudinal axis that defines the center line of the main bearing journals. While the crankshaft is rotating in the second station, at least one spindle supporting at least one pin bearing journal grinding wheel is utilized to machine grind the pin bearing journals of the crankshaft.

The third grinding station machine grinds the crankshaft flywheel flange surfaces and two thrust bearing surfaces. The flywheel flange surfaces consisting of the flywheel flange mating surface, the oil seal surface, and the pilot bore hub surface. In the third grinding station a clamping fixture secures and rotates the crankshaft about the longitudinal axis that defines the center line of the main bearing journals.

While the crankshaft is rotating in the third station, a third spindle supporting a thrust bearing grinding wheel is utilized to machine grind two thrust bearing surfaces and a fourth spindle supporting an angled grinding wheel is utilized to machine grind the flywheel flange surfaces which consists of the flywheel flange mating surface, oil seal surface, and pilot bore hub surface.

In a second illustrative embodiment, a machine for grinding the main bearings, post surface, and gear-fit wall surface is provided. In the machine, a clamping fixture secures and rotates the crankshaft about the longitudinal axis that defines the center line of the main bearing journals.

While the crankshaft is rotating in the machine, a first spindle supporting a pair of ganged main bearing journal grinding wheels (the ganged main bearing journal grinding wheels being aligned longitudinally with a first pair of main bearing journals) advances toward the crankshaft in a radial direction with respect to the main bearing journals. The ganged main bearing journal grinding wheels then come into contact with the first pair of the main bearing journals and machine grind them to the desired dimensions. The first spindle then retracts from the crankshaft, shifts longitudinally with respect to the main bearing journals to a position that is aligned longitudinally with a second pair of main bearing journals. Again, the first spindle advances toward the crankshaft in a radial direction with respect to the main bearing journals. The ganged main bearing journal grinding wheels then come into contact with the second pair of the main bearing journals and machine grind them to the desired dimensions. Once the second pair of main bearing journals is machine ground, the first spindle retracts from the crankshaft and returns to the longitudinal position where the ganged main bearing journal grinding wheels are aligned with the first pair of main bearing journals.

Also, while the crankshaft is rotating in the machine, a second spindle supporting a grinding wheel (the grinding wheel having a main bearing journal grinding surface of the grinding wheel that is aligned longitudinally with a main bearing journal, and the second spindle having an axis of rotation that is parallel with the longitudinal axis that defines the center line of the main bearing journals of the crankshaft) advances toward the crankshaft in a radial direction with respect to the main bearing journal. The main bearing journal grinding surface of the grinding wheel then comes into contact with the main bearing journal and machine grinds the journal to the desired dimension. The second spindle then retracts from the crankshaft, rotates about a B-axis which is perpendicular to both the longitudinal axis that defines the center line of the main bearing journals and a radial axis, to an angled position with respect to the longitudinal axis. Once the second spindle is in the angled position, the second spindle then advances toward the crankshaft where a post grinding surface and a gear-fit wall grinding surface come into contact with the post surface and gear-fit wall surface, respectively, and machine grind the post surface and gear-fit wall surface to the desired dimensions. The second spindle then retracts from the crankshaft and rotates back about the B-axis, so that the second spindle axis is once again aligned parallel with the longitudinal axis that defines the center line of the main bearing journals of the crankshaft.

In a third illustrative embodiment, a method for grinding the main bearings, post surface, and gear-fit wall surface is provided. In this method, a clamping fixture secures and rotates the crankshaft about the longitudinal axis that defines the center line of the main bearing journals. While the crankshaft is rotating, a first spindle supporting a pair of ganged main bearing journal grinding wheels (the ganged main bearing journal grinding wheels being aligned longitudinally with a first pair of main bearing journals) advances toward the crankshaft in a radial direction with respect to the main bearing journals. The ganged main bearing journal grinding wheels then come into contact with the first pair of the main bearing journals and machine grind them to the desired dimensions. The first spindle then retracts from the crankshaft, shifts longitudinally with respect to the main bearing journals to a position that is aligned longitudinally with a second pair of main bearing journals. Again, the first spindle advances toward the crankshaft in a radial direction with respect to the main bearing journals. The ganged main bearing journal grinding wheels then come into contact with the second pair of the main bearing journals and machine grind them to the desired dimensions. Once the second pair of main bearing journals is machine ground, the first spindle retracts from the crankshaft and returns to the longitudinal position where the ganged main bearing journal grinding wheels are aligned with the first pair of main bearing journals.

Also, while the crankshaft is rotating, a second spindle supporting a grinding wheel (the grinding wheel having a main bearing journal grinding surface of the grinding wheel that is aligned longitudinally with a main bearing journal, and the second spindle having an axis of rotation that is parallel with the longitudinal axis that defines the center line of the main bearing journals of the crankshaft) advances toward the crankshaft in a radial direction with respect to the main bearing journal. The main bearing journal grinding surface of the grinding wheel then comes into contact with the main bearing journal and machine grinds the journal to the desired dimension. The second spindle then retracts from the crankshaft, rotates about a B-axis which is perpendicular to both the longitudinal axis that defines the center line of the main bearing journals and a radial axis to an angled position with respect to the longitudinal axis. Once the second spindle is in the angle position, the second spindle then advances toward the crankshaft where a post grinding surface and a gear-fit wall grinding surface come into contact with the post surface and gear-fit wall surface, respectively, and machine grind the post surface and gear-fit wall surface to the desired dimensions. The second spindle then retracts from the crankshaft and rotates back about the B-axis, so that the spindle axis is once again aligned parallel with the longitudinal axis that defines the center line of the main bearing journals of the crankshaft.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
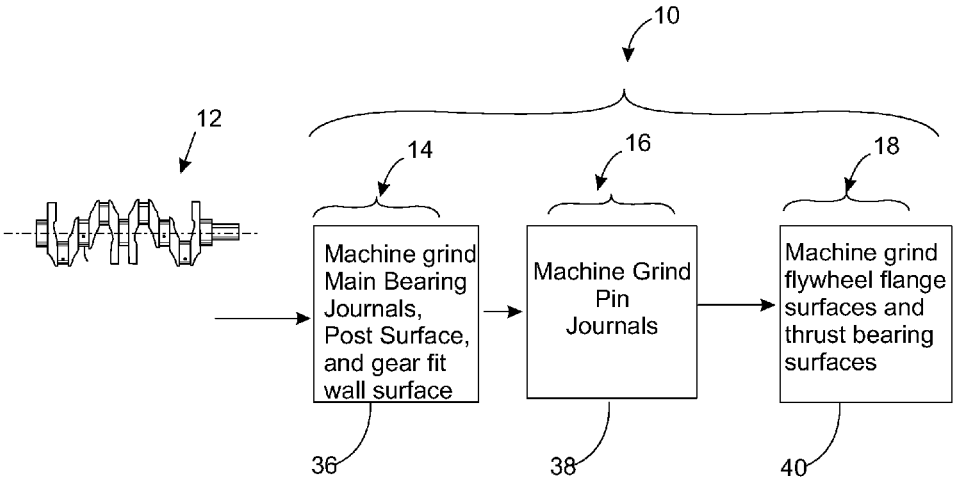
FIG. 1 is a block diagram describing the machining operation at each station of the crankshaft grinding system.
Figure 3:
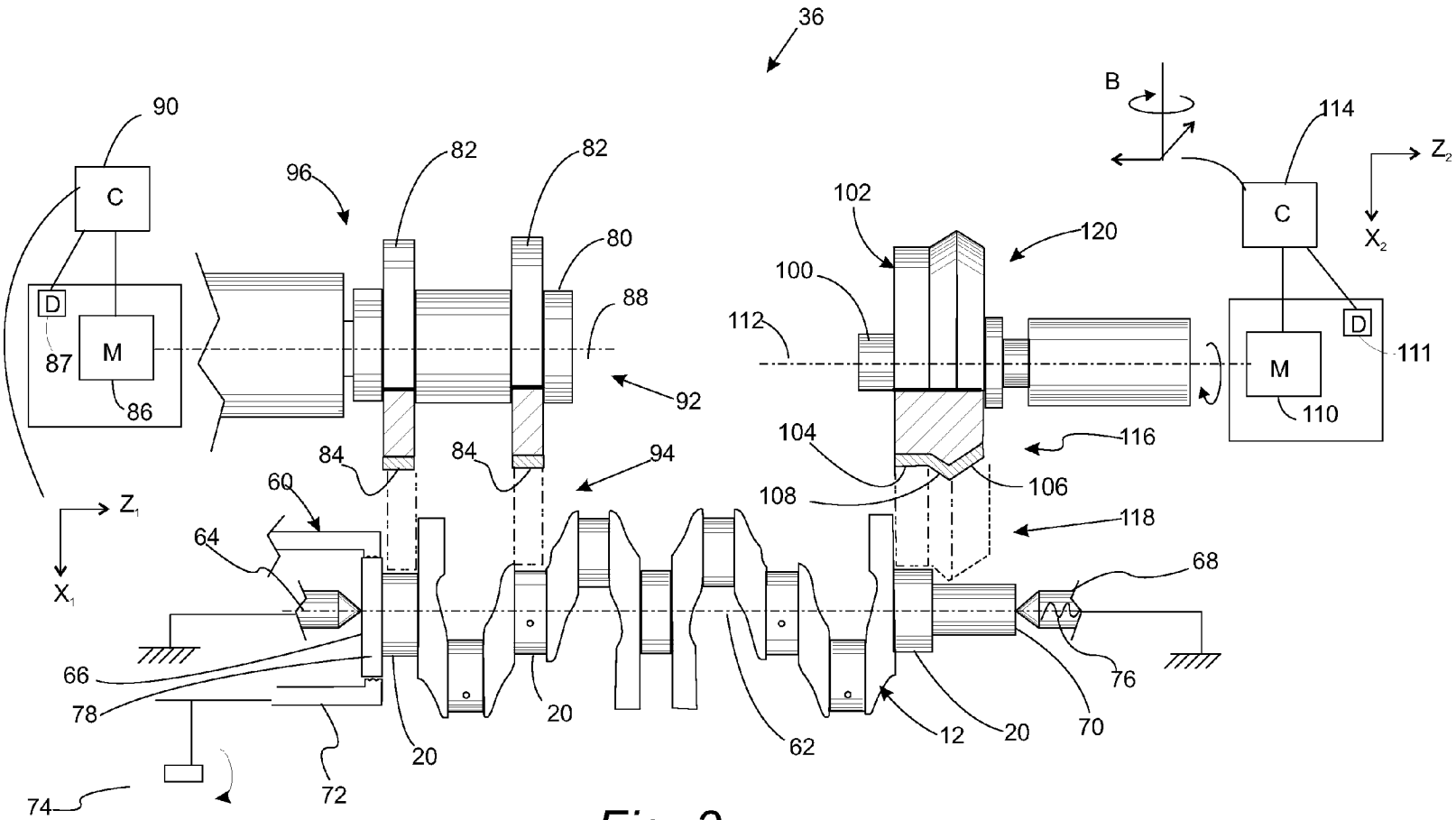
FIG. 3 is plan view of the machine in the first station illustrating the machine grinding process for three of the main bearing journals.

A system 10 for machine grinding a crankshaft 12 for a four cylinder engine is illustrated by the block diagram in FIG. 1. The system 10 consists of a first station 14, a second station 16, and a third station 18. In the first station 14, the main bearing journals 20, the post surface 22, and the gear-fit wall surface 24 of crankshaft 12, shown in greater detail in FIG. 3 are machine ground to the desired dimensions. In, the second station 16 is the pin journals 26 are machine ground to the desired dimensions. Finally, in the third station 18, the thrust bearing surfaces 28, flywheel flange mating surface 30, oil seal surface 32, and pilot bore hub surface 34 are machine ground to the desired dimensions.

Each station is capable of attaining a desired production rate of 48 jobs per hour (jph) utilizing only one grinding machine in each of the three stations. The desired production rate of 48 jph is derived from a 60 second cycle time, which includes 9 seconds for loading and unloading the crankshaft 12, operating at 80% efficiency. A first grinding machine 36 is responsible for machine grinding, the main bearing journals 20, the post surface 22, and the gear-fit wall surface 24 in the first station 14; a second grinding machine 38 is responsible for machine grinding the pin journals 26 in the second station 16; and a third grinding machine 40 is responsible for machine grinding the thrust bearing surfaces 28, flywheel flange mating surface 30, oil seal surface 32, and pilot bore hub surface 34 in the third station 18.

Figure 2:
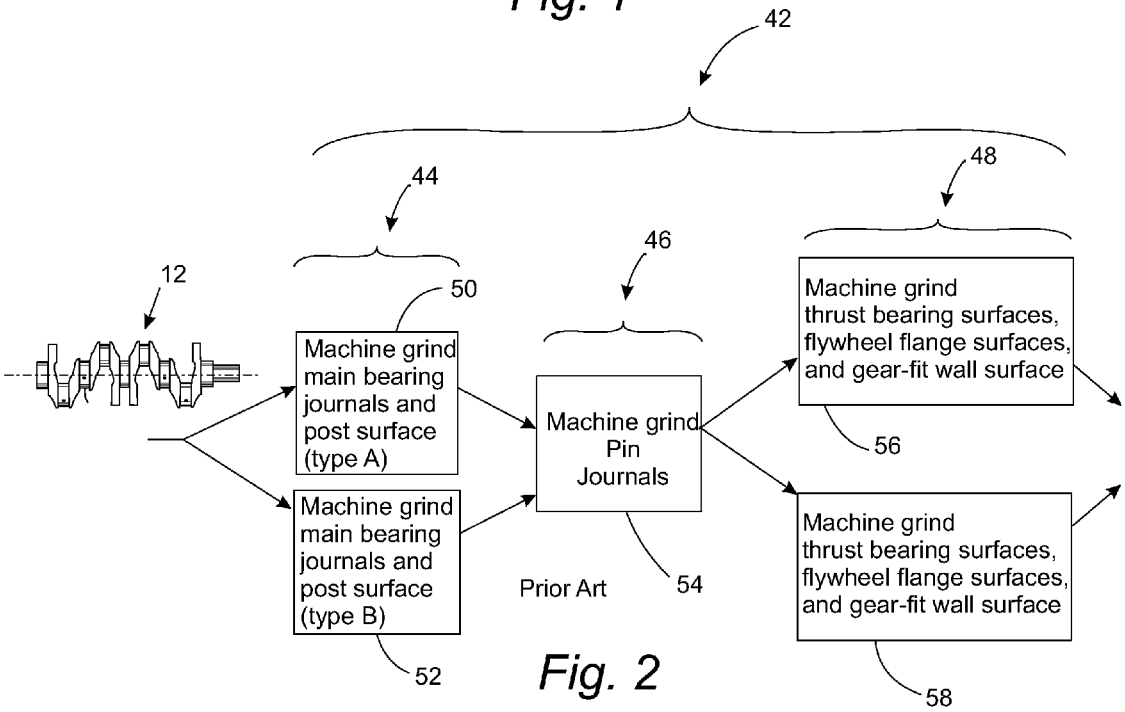
FIG. 2 is a block diagram describing the machining operation at each station of a prior art crankshaft grinding system.

A previously utilized prior art system 42 for machine grinding a crankshaft 12 for a four cylinder engine is illustrated by the block diagram in FIG. 2. The system 42 consists of a first station 44, a second station 46, and a third station 48. In the first station 44, the main bearing journals 20 and post surface 22 are machine ground to the desired dimensions. In the second station 46, the pin journals 26 are machine ground to the desired dimensions. Finally, in the third station 48, the thrust bearing surfaces 28, flywheel flange mating surface 30, oil seal surface 32, pilot bore hub surface 34, and the gear-fit wall surface 24 are machine ground to the desired dimensions. The previously utilized system 42 however, is only capable of attaining the desired production rate of 48 jph if multiple grinding machines are utilized in the first station 44 and the third station 48.

Multiple grinding machines are required to machine grind the main bearing journals 20 and post surface 22 in the first station 44 when multiple crankshaft part types are being machined. As illustrated in FIG. 2, two grinding machines are required when two crankshaft part types are being produced. One grinding machine 50 is required for machine grinding a first crankshaft part type A and a second grinding machine 52 is required for machine grinding a second crankshaft part type B. Multiple grinding machines are required in the first station 44 when multiple crankshaft part types are being machined because the changeover time to convert the grinding machine from one crankshaft part type to another is time consuming, shutting down production and increasing labor costs.

Still referring to FIG. 2, the previously utilized system 42 requires one grinding machine 54 in the second station 46 to machine grind the pin journals 26 at the desired production rate.

The third station 48 of the previously utilized system 42 requires two grinding machines 56, 58 to machine grind the thrust bearing surfaces 28, flywheel flange mating surface 30, oil seal surface 32, pilot bore hub surface 34, and the gear-fit wall surface 24 in order obtain the desired production rate. The third station 48 of the previously utilized system 42 is unable to attain the desired production rate with one grinding machine because of the multitude of steps required to machine grind the several surfaces in the third station 48.

Unlike the previously utilized system 42, the system 10 for machine grinding a crankshaft 12 for a four cylinder engine is capable of attaining the desired production rate of 48 jph with one grinding machine at each station. Furthermore, the configuration of grinding machine 36 in the first station 14 allows for the quick changeover between crankshaft designs unlike grinding machines 50, 52 in the first station 44 of the previously utilized system 42. In addition, the third station 18 is able to attain the desired production rate with one grinding machine 40 unlike the third station 48 of the previously utilized system 42. This is because the grinding machine 40 has a shorter cycle time than grinding machines 56, 58, the shorter cycle time being the result of grinding machine 40 only machine grinding the thrust bearing surfaces 28, flywheel flange mating surface 30, oil seal surface 32, pilot bore hub surface 34, while the grinding machines 56, 58 are machine grinding all of the same surfaces that grinding machine 40 is machine grinding plus the gear-fit wall surface 24.

Figure 4A:
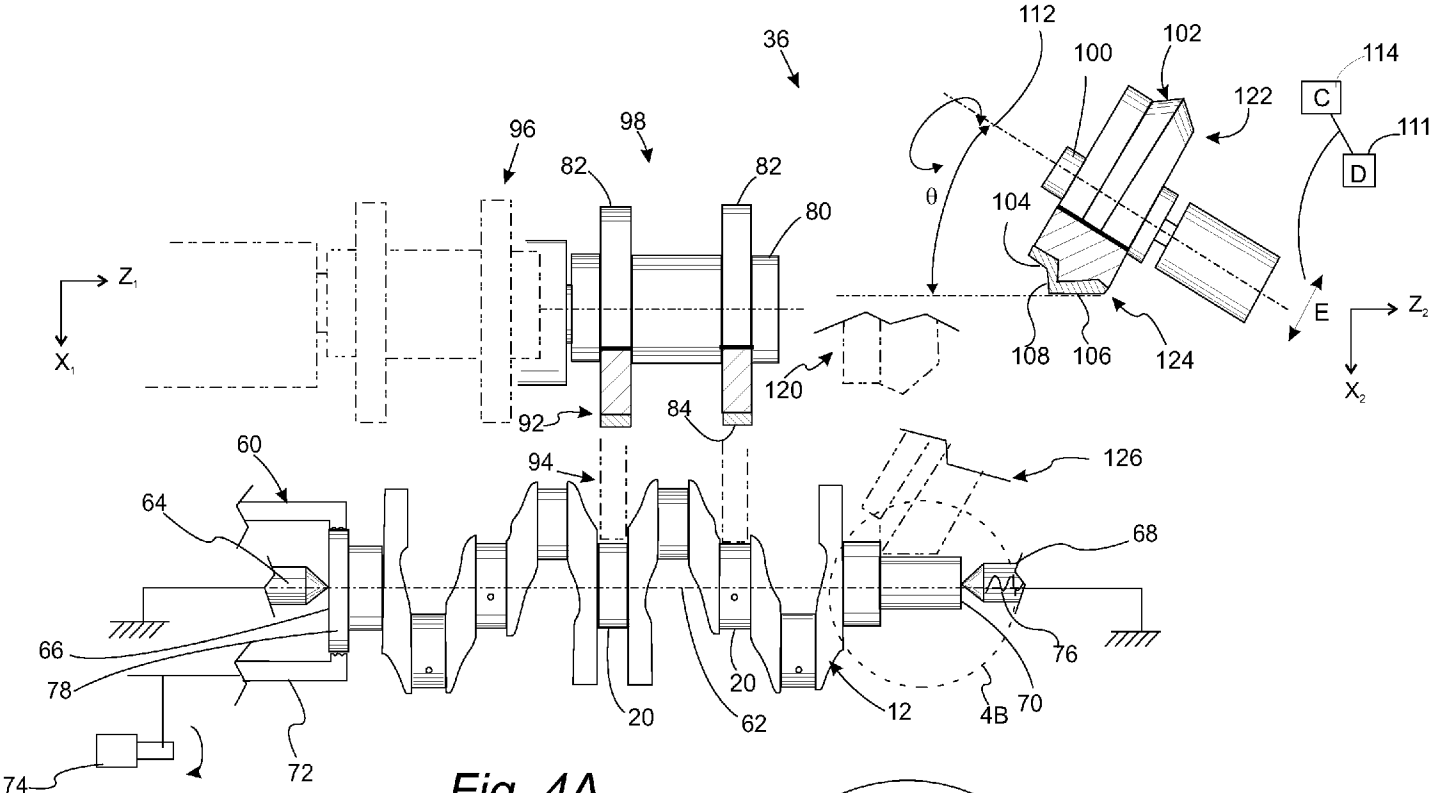
FIG. 4A is plan view of the machine in the first station illustrating the machine grinding process for two of the main bearing journals, the post surface, and the gear-fit wall surface.

Referring to FIGS. 3 and 4A, the first grinding machine 36 located at the first station 14 is illustrated. The first grinding machine 36 includes a first clamping fixture 60 that secures and rotates the crankshaft about a longitudinal axis 62 that defines the center line of the several main bearing journals 20. The illustrated first clamping fixture 60 includes a first center point 64 that locates and secures a first end 66 of the crankshaft, a second center point 68 that locates and secures a second end 70 of the crankshaft, and an eccentric chuck 72 having a rotational power source 74. One of the center points preferably includes a spring 76 to aid in securing the location crankshaft 12. The chuck 72 clamps to the flywheel flange 78 of the crankshaft 12 and the rotational power source 74 rotates the chuck 72, which in turn rotates the crankshaft 12 about the center points 64, 68 which are centered along the longitudinal axis 62 that defines the center line of the several main bearing journals 20. The chuck 72 accommodates manufacturing tolerances in the yet unmachined flywheel flange 78.

The first grinding machine 36 includes a first spindle 80 supporting a pair of ganged main bearing journal grinding wheels 82. The pair of ganged main bearing journal grinding wheels 82 each include a contact surface 84 located on the periphery of the main bearing journal grinding wheel 82 which is made from a hard material, such as cubic boron nitride (hereinafter "CBN"). Typically the CBN portion of a grinding wheel that forms a contact surface is between 3 mm-5 mm thick. A motor 86 is utilized to rotate the first spindle 80 about a central axis 88. The first spindle 80 is moveable in both an X1 and Z1 direction by a drive 87. Movement in the Z1 direction is movement that is longitudinal with respect to the main bearing journals 20 of the crankshaft 12. Movement in the X1 direction is movement that is radial with respect main bearing journals 20 of the crankshaft 12. A controller 90 is utilized to control the motor 86 and drive 87, to rotate the first spindle 80 about the central axis 88 and move the first spindle 80 in the X1 and Z1 directions. The first spindle 80 includes a first retracted position 92 and a first advanced position 94 in the X1 direction; and a first indexed position 96 and a second indexed position 98 in the Z1 direction. A single controller can control the entire system or control may be distributed between a number of controllers at the machine or the spindle level which work in cooperation. Not shown are the conventional lift and transfer handling equipment used to move the crankshaft into and out of each station. The transfer equipment is controlled in unison with the grinding system.

As illustrated in FIG. 3, with the crankshaft 12 rotating in the first clamping fixture 60 and the first spindle 80 rotating about the central axis 88, a first pair of main bearings 20 is machine ground by the contact surfaces 84 of the pair of ganged main bearing journal grinding wheels 82 when the first spindle 80 in the first indexed position 96 moves from the first retracted position 92 to the first advanced position 94.

As illustrated in FIG. 4A, with the crankshaft 12 rotating in the first clamping fixture 60 and the first spindle 80 rotating about the central axis 88, a second pair of main bearings 20 is machine ground by the contact surfaces 84 of the pair of ganged main bearing journal grinding wheels 82 when the first spindle 80 in the second indexed position 98 moves from the first retracted position 92 to the first advanced position 94.

Still referring to FIGS. 3 and 4A, the first grinding machine 36 also includes a second spindle 100 supporting a grinding wheel 102. The grinding wheel 102 includes a main bearing journal contact surface 104, a post grinding surface 106 which is inclined relative to the main bearing journal contact surface 104, and a gear-fit wall grinding surface 108 which is also inclined relative to the main bearing journal contact surface 104. Grinding wheel 102 can be one piece as shown or two pieces having a cylindrical wheel which includes the main bearing journal contact surface 104 and a frusto conical wheel which includes the post grinding surface 106 and gear-fit wall grinding surface 108. The main bearing journal contact surface 104, post grinding surface 106, and gear-fit wall grinding surface 108 are located on the periphery of the grinding wheel 102 and are made from a hard material, such as CBN. Typically the CBN portion of a grinding wheel that forms a contact surface is between 3 mm-5 mm thick.

A motor 110 is utilized to rotate the second spindle 100 about a central axis 112. The second spindle 100 is moveable in an X2 direction, Z2 direction, rotatable about a B-axis, and moveable in an E direction by a drive 111. The B-axis is perpendicular to the plane formed by the X2 and Z2 directions and is also perpendicular to the longitudinal axis 62 that defines the center line of the several main bearing journals 20. The E direction is perpendicular to the central axis 112 of the second spindle 100 and a radial axis, when the second spindle has been rotated about the B-axis so that the central axis 112 is at an angle θ relative to the Z2 direction. A controller 114 is utilized to control the motor 110 and drive 111, to rotate the second spindle 100 about the central axis 112, move the second spindle 100 in the X2 direction, move the second spindle 100 in the Z2 direction, rotate the second spindle 100 about the B-axis, and move the second spindle 100 in the E direction. Movement in the E direction may either be on a single axis or an interpolation of movements in both the X2 and Z2 directions. The spindle 100 includes a second retracted position 116 and a second advanced position 118 in the X2 direction; a first rotated position 120 and a second rotated position 122 about the B-axis; and a third retracted position 124 and a third advanced position 126 in the E direction.

As illustrated in FIG. 3, with the crankshaft 12 rotating in the first clamping fixture 60 and the second spindle 100 rotating about the central axis 112, a main bearing journal 20 is machine ground by the main bearing journal contact surface 104 of the grinding wheel 102 when the second spindle 100 in the first rotated position 120 moves from the second retracted position 116 to the second advanced position 118.

As illustrated in FIG. 4A, with the crankshaft 12 rotating in the first clamping fixture 60 and the second spindle 100 rotating about the central axis 112, the post surface 22 and the gear-fit wall surface 24 are machine ground by the post grinding surface 106 and the gear-fit wall grinding surface 108, respectively, of the grinding wheel 102 when the second spindle 100 in the second rotated position 122 moves from the third retracted position 124 to the third advanced position 126.

Figure 4B:
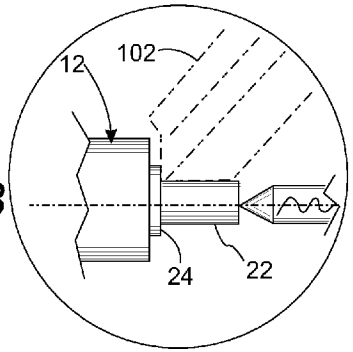
FIG. 4B is a magnified view of the portion of FIG. 4A within circle 4B.

FIG. 4B is illustrates the contact between the grinding wheel 102 and the post surface 22 and gear-fit wall surface 24 of the crankshaft 12.

Figure 5:
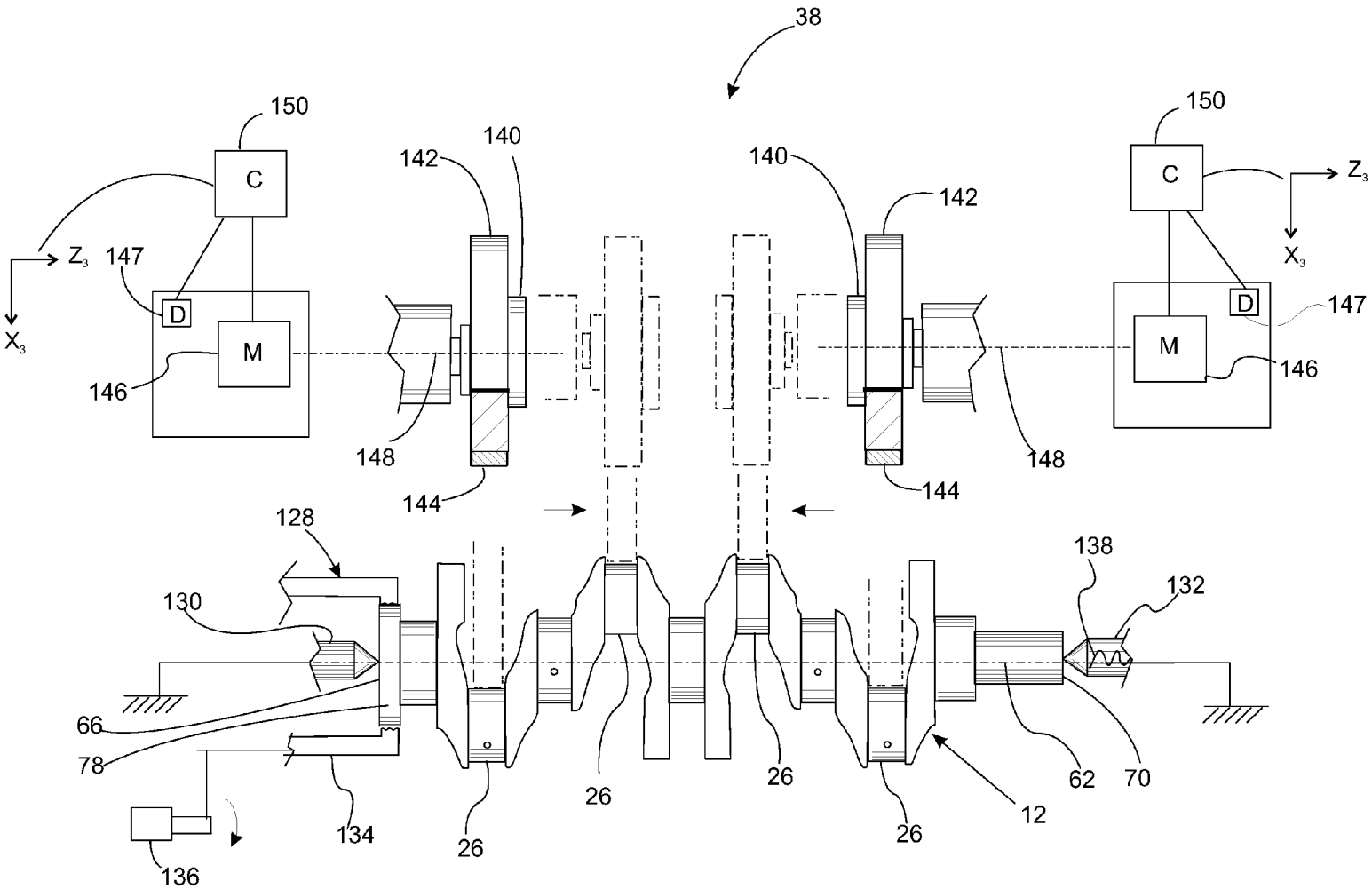
FIG. 5 is a plan view of the machine in the second station illustrating the machine grinding process for the pin bearing journals.

Referring to FIG. 5, the second grinding machine 38 located at the second station 16 is illustrated. The second grinding machine 38 includes a second clamping fixture 128 that secures and rotates the crankshaft 12 about the longitudinal axis 62 that defines the center line of the several main bearing journals 20. The illustrated second clamping fixture 128 includes a first center point 130 that locates and secures the first end 66 of the crankshaft, a second center point 132 that locates and secures a second end 70 of the crankshaft, and a chuck 134 having a rotational power source 136. One of the center points preferably includes a spring 138 to aid in securing the location crankshaft 12. The chuck 134 clamps to the flywheel flange 78 of the crankshaft 12 and the rotational power source 136 rotates the chuck 134, which in turn rotates the crankshaft 12 about the center points 130, 132 which are centered along the longitudinal axis 62 that defines the center line of the several main bearing journals 20.

The second grinding machine 38 includes at least one spindle 140 supporting at least one pin bearing journal grinding wheel 142. The at least one pin bearing journal grinding wheel 142 includes a contact surface 144 which is located on the periphery of the at least one pin bearing journal grinding wheel 142 and is made from a hard material, such as CBN. Typically the CBN portion of a grinding wheel that forms a contact surface is between 3 mm-5 mm thick. A motor 146 is utilized to rotate the at least one spindle 140 about a central axis 148. The at least one spindle 140 is moveable in both an X3 and Z3 direction by a drive 147. Movement in the Z3 direction is movement that is longitudinal with respect to the main bearing journals 20 of the crankshaft 12. Movement in the X3 direction is movement that is radial with respect main bearing journals 20 of the crankshaft 12. A controller 150 is utilized to control the motor 146 and drive 147, to rotate the at least on spindle about the central axis 148 and move the at least one spindle 140 in the X3 and Z3 directions.

As illustrated in FIG. 5, with the crankshaft 12 rotating in the clamping fixture 128, the at least one spindle 140 rotating about the central axis 148, and the at least one pin journal grinding wheel 142 being aligned longitudinally in the Z3 direction with one pin journal 26, the pin journal 26 that the grinding wheel 142 is aligned with is machine ground by the contact surface 144 of the at least one pin journal grinding wheel 142. During the machine grinding process, the at least one spindle 140 is advanced in the X3 direction so that the contact surface 144 contacts the pin journal 26, while the at least one spindle 140 reciprocates in the X3 direction as the crankshaft 12 rotates about the longitudinal axis 62 that defines the center line of the several main bearing journals 20. After the pin journal 26 has been machine ground, the at least one spindle 140 then retracts in the X3 direction from the pin journal 26 and indexes in the Z3 direction so that the at least one pin journal grinding wheel 142 is now aligned longitudinally in the Z3 direction with another pin journal 26 that requires machining. The process then repeats until all of the pin journals 26 have been machine ground.

Still referring still. FIG. 5, although the illustrated embodiment of the second grinding machine 38 indicates there being two spindles 140 with grinding wheels 142 for machine grinding the pin journals 26, the second grinding machine 38 should not be construed as limited to having two spindles 140 with grinding wheels 142, but should include grinding machines having one or more spindles with grinding wheels for the purpose of machine grinding the pin journals 26.

Referring to FIG. 6, the third grinding machine 40 located at the third station 18 is illustrated. The third grinding machine 40 includes a third clamping fixture 152 that secures and rotates the crankshaft 12 about the longitudinal axis 62 that defines the center line of the several main bearing journals 20. The illustrated third clamping fixture 152 includes a first center point 154 that locates and secures the first end 66 of the crankshaft, a second center point 156 that locates and secures a second end 70 of the crankshaft, and a chuck 158 having a rotational power source 160. One of the center points preferably includes a spring 162 to aid in securing the location crankshaft 12. The chuck 158 clamps to the post surface 22 of the crankshaft 12 and the rotational power source 160 rotates the chuck 158, which in turn rotates the crankshaft 12 about the center points 154, 156 which are centered along the longitudinal axis 62 that defines the center line of the several main bearing journals 20.

The third grinding machine 40 includes a third spindle 164 supporting a thrust bearing grinding wheel 166. The thrust bearing grinding wheel 166 includes contact surfaces 168 which are located on each side of the grinding wheel and are made from a hard material, such as CBN. Typically the CBN portion of a grinding wheel that forms a contact surface is between 3 mm-5 mm thick. A motor 170 is utilized to rotate the third spindle 164 about a central axis 172. The third spindle 164 is moveable in both an X4 and Z4 direction by a drive 171. Movement in the Z4 direction is movement that is longitudinal with respect to the main bearing journals 20 of the crankshaft 12. Movement in the X4 direction is movement that is radial with respect main bearing journals 20 of the crankshaft 12. A controller 174 is utilized to control the motor 170 and drive 171, to rotate the third spindle 164 about the central axis 172 and move the third spindle 164 in the X4 and Z4 directions.

Figure 6A:
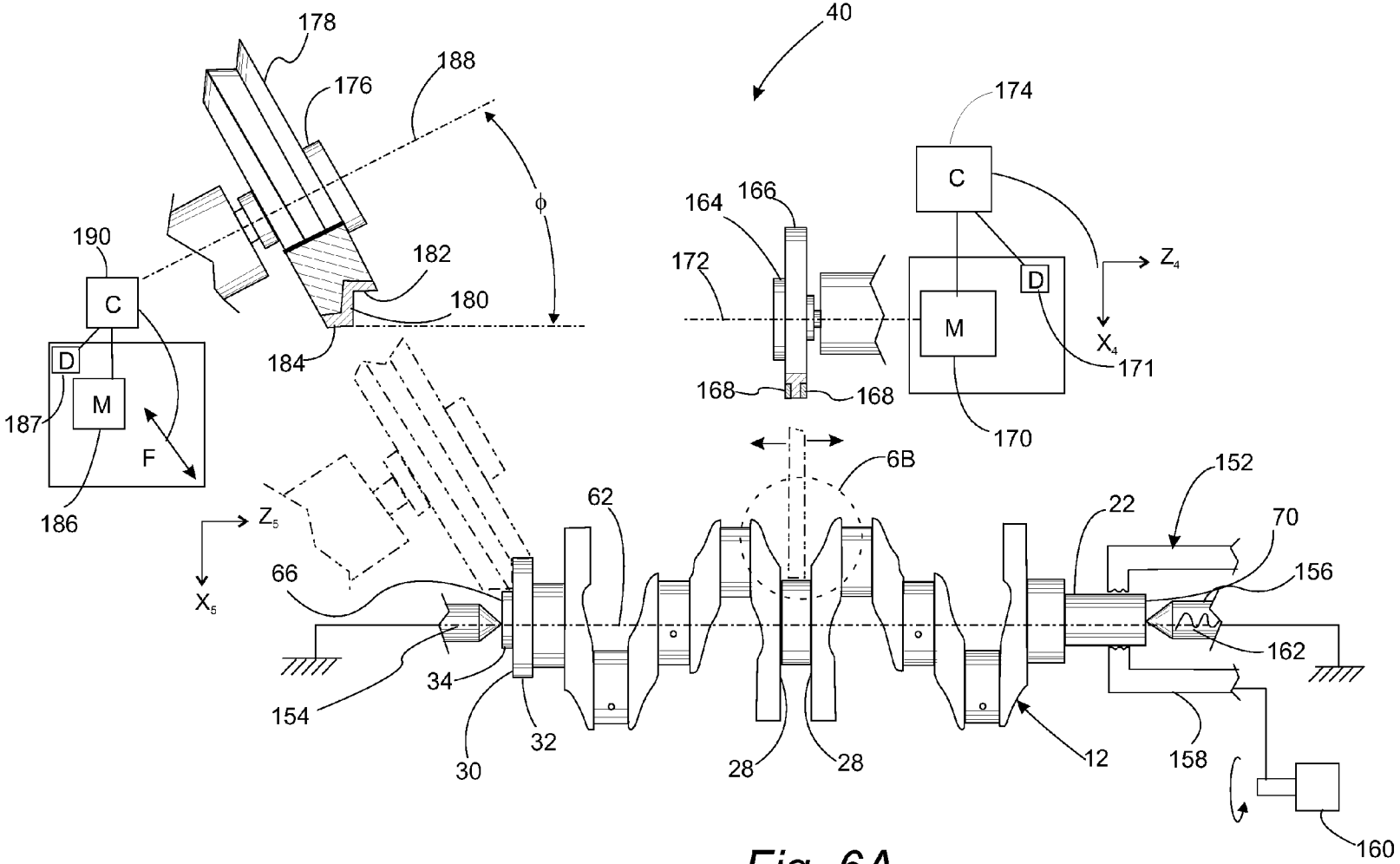
FIG. 6A is a plan view of the machine in the third station illustrating the machine grinding process for the thrust bearing surfaces and the flywheel flange surfaces.
Figure 6B:
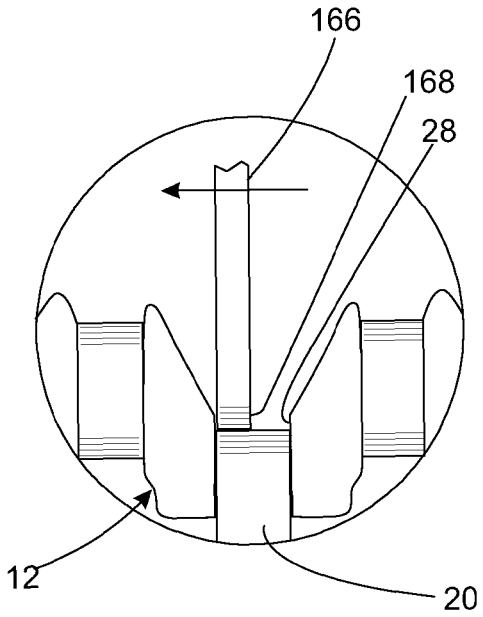
FIG. 6B is a magnified view of the portion of FIG. 6A within circle 6B, illustrating the thrust bearing grinding wheel at the far left position.
Figure 6C:
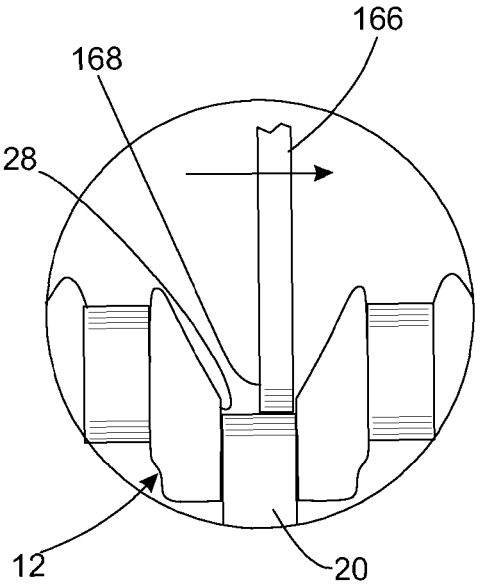
FIG. 6C is a magnified view of the portion of FIG. 6A within circle 6B, illustrating the thrust bearing grinding wheel at the far right position.

As illustrated in FIGS. 6A-6C, with the crankshaft 12 rotating in the third clamping fixture 152 and the third spindle 164 rotating about the central axis 172, the third spindle 164 is advanced in the X4 direction so that periphery of the grinding wheel stops just short of the main bearing 20 located near the center of the crankshaft. Once the third spindle has advanced in the X4 direction, the third spindle 164 shifts in a negative Z4 direction so that the contact surface 168 of the thrust bearing grinding wheel 166 machine grinds a first thrust bearing surface 28 when the thrust bearing grinding wheel 166 comes into contact with the crankshaft 12, as illustrated in FIG. 6B. Once the first thrust bearing surface is machine ground, the third spindle 164 shifts in a positive Z4 direction so that the contact surface 168 of the thrust bearing grinding wheel 166 machine grinds a second thrust bearing surface 28 when the thrust bearing grinding wheel 166 comes into contact with the crankshaft 12, as illustrated in FIG. 6C.

Still referring to FIG. 6A, the third grinding machine 40 also includes a fourth spindle 176 supporting an angled grinding wheel 178. The angle grinding wheel 178 includes a flywheel mating grinding surface 180, an oil seal grinding surface 182, and a pilot bore hub grinding surface 184. The flywheel mating grinding surface 180, oil seal grinding surface 182, and pilot bore hub grinding surface 184 are located on the periphery of the angled grinding wheel 178 and are made from a hard material, such as CBN. Typically the CBN portion of a grinding wheel that forms a contact surface is between 3 mm-5 mm thick. A motor 186 is utilized to rotate the fourth spindle 176 about a central axis 188. The fourth spindle 176 is moveable in an F direction by a drive 187. A controller 190 is utilized to control the motor 186 and drive 187, to rotate the fourth spindle 176 about the central axis 188, move the fourth spindle in an X5 direction, move the fourth spindle in a Z5 direction, and move the fourth spindle 176 in the F direction. The F direction is perpendicular to the central axis 188 of the fourth spindle 176, and is at an angle Φ relative to the Z5 direction. Movement if the F direction may either be on a single axis or an interpolation of movements in both the X5 and Z5 directions.

As illustrated in FIG. 6, with the crankshaft 12 rotating in the third clamping fixture 152 and the fourth spindle 176 rotating about the central axis 188, the flywheel mating grinding surface 180, oil seal grinding surface 182, and pilot bore hub grinding surface 184 of the angled grinding wheel 178 machine grind the flywheel flange mating surface 30, oil seal surface 32, and pilot bore hub surface 34, respectively, when the fourth spindle 176 advances in the F direction and the angled grinding wheel comes into contact with the crankshaft 12.

While exemplary embodiments are described above, it is not intended that these embodiments describe all possible forms of the invention. Rather, the words used in the specification are words of description rather than limitation, and it is understood that various changes may be made without departing from the spirit and scope of the invention. For example, the order of the three stations could be changed so that the first station is not first in time. Additionally, the features of various implementing embodiments may be combined to form further embodiments of the invention.

What is claimed is:

1. A method for grinding a plurality of main bearing journals, a post surface, and a gear-fit wall surface of a crankshaft comprising:

clamping and rotating the crankshaft about a longitudinal axis that defines the center line of the plurality of main bearing journals;

advancing a first spindle, the first spindle supporting a pair of ganged main bearing journal grinding wheels, from a first retracted position to a first advanced position when the first spindle is in a first indexed position;

grinding a first pair of main bearing journals with the ganged main bearing journal grinding wheels;

returning the first spindle to the first retracted position;

indexing the first spindle from the first indexed position to a second indexed position;

advancing the first spindle from the first retracted position to the first advanced position when the first spindle is in the second indexed position;

grinding a second pair of main bearing journals with the ganged main bearing journal grinding wheels;

returning the first spindle to the first retracted position;

returning the first spindle from the second indexed position to the first indexed position;

advancing a second spindle, the second spindle supporting a grinding wheel, the grinding wheel having a main bearing journal grinding surface, a post grinding surface which is inclined relative to the main bearing journal grinding surface, and a gear-fit wall grinding surface which is inclined relative to the main bearing journal grinding surface, from a second retracted position to a second advanced position when the second spindle is in a first rotated position;

grinding a main bearing journal of the crankshaft with the grinding wheel;

returning the second spindle to the second retracted position;

rotating the second spindle from the first rotated position to a second rotated position about a B-axis that is perpendicular to the longitudinal axis that defines the center line of the plurality of main bearing journals;

advancing the second spindle from a third retracted position to a third advanced position when the second spindle is in the second rotated position;

grinding the post surface and the gear-fit wall surface of the crankshaft with the grinding wheel;

returning the second spindle to the third retracted position; and rotating the second spindle from the second rotated position to the first rotated position.

2. The method of claim 1, wherein the pair of ganged main bearing journal grinding wheels each have a contact surface made from cubic boron nitride that comes into contact with crankshaft during the grinding process.

3. The method of claim 1, wherein the main bearing journal grinding surface, post grinding surface, and gear-fit wall grinding surface of the grinding wheel supported by the second spindle are made from cubic boron nitride.

4. The method of claim 1, wherein the crankshaft is for a four cylinder engine.

5. The method of claim 1, wherein a first center point locates and secures a first end of the crankshaft, a second center point that locates and secures a second end of the crankshaft, and a chuck clamps and rotates the crankshaft about the first and second center points.

6. The method of claim 5, wherein the chuck clamps to the post surface located on the crankshaft.

* * * * *